United States Patent [19]

Nakai

[11] 4,146,789

[45] Mar. 27, 1979

[54] MULTI-PIN ELECTRODE ASSEMBLY

[75] Inventor: Syunzi Nakai, Moriguchi, Japan

[73] Assignee: Sharp Kabushiki Kaisha, Osaka, Japan

[21] Appl. No.: 844,203

[22] Filed: Oct. 21, 1977

[30] Foreign Application Priority Data

Oct. 25, 1976 [JP] Japan ..... 51-128668

[51] Int. Cl.[2] ..... H01T 19/04

[52] U.S. Cl. ..... 250/324; 313/351

[58] Field of Search ..... 250/324, 325, 326; 313/309, 351

[56] References Cited

U.S. PATENT DOCUMENTS 3,655,966 4/1972 Takimoto et al. ..... 250/324

3,935,455 1/1976 Van den Bogaert ..... 250/324 X

*Primary Examiner*—Alfred E. Smith

*Assistant Examiner*—Charles F. Roberts

*Attorney, Agent, or Firm*—Birch, Stewart, Kolasch & Birch

[57] ABSTRACT

A multi-pin electrode includes a plurality of pin electrodes which are divided into n groups, each having m pin electrodes. The assembly further includes an elongated body and m sheets of elongated plate members which are cumulated one over the other on the elongated body. The pin electrodes in one group are connected in such a manner that the first, second, . . . , mth pin electrodes are connected between the elongated body and first, second, . . . , mth elongated plate members, respectively, so as to have the pin electrodes positioned in the same places in each group electrically terminate in the same elongated plate member.

6 Claims, 8 Drawing Figures

FIG. 1 PRIOR ART
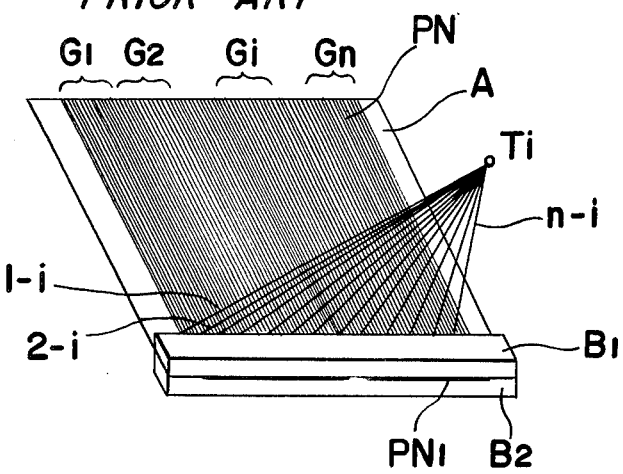
FIG. 2 PRINCIPLE
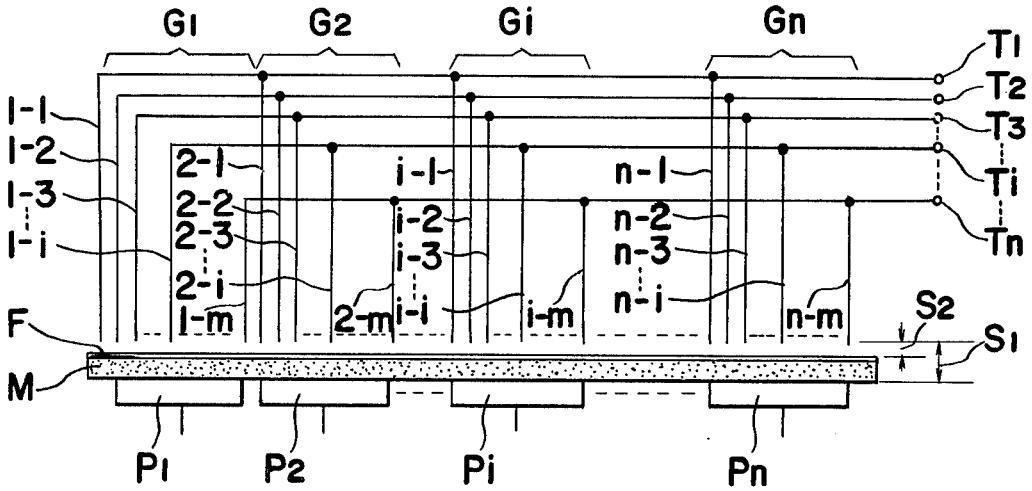
FIG. 3 PRIOR ART
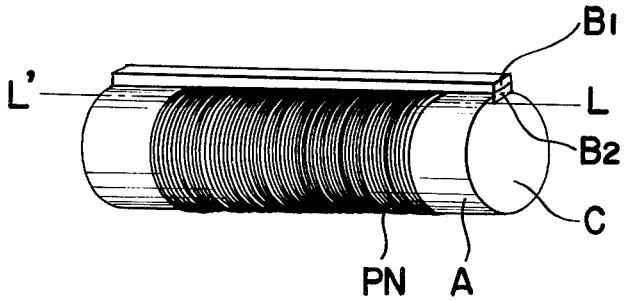

MULTI-PIN ELECTRODE ASSEMBLY

BACKGROUND OF THE INVENTION

The present invention relates to an electrographic recording device for use in an information processing apparatus such as computer or facsimile and, more particularly, to a multi-pin electrode assembly employed in the electrographic recording device, and also to a method for manufacturing the same.

The multi-pin electrode assembly known in the art, as shown in FIG. 1, includes a plurality of pin electrodes which are generally indicated by a reference character PN and are parallely aligned to each other with tip ends $PN_1$ thereof being in alignment with each other. The plurality of pin electrodes may be provided over a suitable substratum A, and the tip ends $PN_1$ thereof may be rigidly supported on the substratum A and held between a pair of supporting bar members $B_1$ and $B_2$. While the pin electrodes PN are thus aligned, the pin electrodes are divided, after every m pin electrodes from the pin electrode positioned at one end of the alignment, into n groups, which are indicated by reference characters $G_1, G_2, \ldots, G_i, \ldots, G_n$, respectively, and each group, represented by a group $G_i$, as schematically shown in FIG. 2, includes m pin electrodes which are indicated by reference characters i-1, i-2, . . ., i-i, . . ., i-m, respectively. It is to be noted that n and m are any numbers and i is a number smaller than n or m. All the first electrodes 1-1, 2-1, . . ., i-1, . . ., n-1 in each group are connected to each other to terminate at a first terminal $T_1$, and in similar manner, the rest of the corresponding electrodes which are positioned at the same place in each group are connected to each other to terminate at respective terminals $T_2, T_3, \ldots, T_i, \ldots, T_n$.

The multi-pin electrode assembly, as described above, is generally employed in the electrographic recording device as a recording head where it is so arranged as to constitute an electrostatic recording system. Among various types of recording systems, the electrostatic recording system is known for its high-speed procedure in the process of recording the information.

The electrographic recording device includes, as shown in FIG. 2, the multi-pin electrode assembly having the terminals $T_1, T_2, \ldots, T_n$ connected to respective signal source (not shown), and a set of electrode array of opposite electrode with respect to the pin electrode. The electrode array includes electrode plate members $P_1, P_2, \ldots, P_i, \ldots, P_n$ which are separated from each other and are aligned to each other along the alignment of the pin electrode tip ends $PN_1$ in a spaced relation thereto by the amount of $S_1$. As apparent from FIG. 2, the plate members $P_1, P_2, \ldots, P_n$ are positioned in face to face relation with the pin electrode tip ends included in the groups $G_1, G_2, \ldots, G_n$, respectively. The electrostatic recording is effected by a discharge of charged film F of dielectric material provided over a recording medium M which moves past the space $S_1$. While the recording medium M moves past the space $S_1$, i.e., between the opposite electrodes, the voltage applied therebetween produces an arc discharge at an extremely narrow space $S_2$ formed between the pin electrodes and the film F, so as to form a latent image on the film F. The film having passed through the space $S_1$ is, then, coated with spread toner particles which are charged in opposite polarity to that of the film to turn or develop the latent image into a visual image. Thereafter, the film is suitably processed to fix the visual image on the film.

According to such electrographic recording device, the pin electrode assembly of conventional type is prepared through the following steps.

First, the substratum A made of comparatively flexible material is formed into a cylindrical form, as shown in FIG. 3, preferably wrapped around a core C. Then, an insulated thin wire, which will serve as pin electrodes, is spirally wound around the cylinder A in high density such as 8 turns/mm. The number of turns for preparing the above described pin electrode assembly is equal to m times n turns. In order to hold the wound wire thereon, the outer surface of the cylinder may be coated with an adhesive material, or otherwise, a strip of adhesive tape may be extended over the wound wire. Then, the pair of supporting bar members $B_1$ and $B_2$ are positioned correspondingly outside and inside of the cylinder for tightly holding the cylinder therebetween together with the wire. Thereafter, the cylinder, together with the wire, is cut along a line L–L′ which is extended closely adjacent the longitudinal edge of the bar members $B_1$ and $B_2$ so as to be spread out into the substratum A to form the pin electrode assembly shown in FIG. 1. The pin electrode on the substratum A are divided into a plurality of groups as in the manner described above, and the pin electrodes positioned at the same place are connected to each other and further to respective terminals.

In the conventional pin electrode assembly as described above, the operations of dividing the pin electrodes into plurality of groups and connecting the corresponding pin electrodes are carried out by skilled workers, since such operations are comparatively difficult to be taken over by an automatically operating machine. Therefore, there have been such drawbacks in the conventional pin electrode assembly that the groups may not include a required number of pin electrodes or that the pin electrodes might be erroneously connected to the terminals due to misleading or miscounting of the electrodes especially when the number of the pin electrodes in one group increases or when the density of the electrode becomes higher than 8 pin electrode/mm. Furthermore, it has taken a comparatively long period of time before completing one pin electrode assembly.

SUMMARY OF THE INVENTION

Accordingly, a primary object of the present invention is to provide an improved pin electrode assembly which can be simply and properly divided into a plurality of groups without requiring any skilled workers to count the number of aligned pin electrodes.

Another object of the present invention is to provide a pin electrode assembly of the above described type which can be manufactured by an automatically operated machine.

Further object of the present invention is to provide a pin electrode assembly of the above described type which is perfect in electrical connections and durable in actual use with high reliability.

In order to accomplish these and other objects, the multi-pin electrode assembly of the present invention comprises an insulated elongated body and m sheets of elongated plate members each having opposite flat surfaces in which one surface thereof is formed with insulating material and the other surface thereof is formed with electrically conductive material. The elongated plate members are cumulated one over the other on said elongated body, with the insulated surface of one elongated plate member being in face to face relation with the conductive surface of neighboring elongated plate member. The multi-pin electrode assembly of the present invention further comprises an alignment of plurality of pin electrodes which extend in parallel to each other over the elongated body and the elongated plate members with a predetermined distance of pitch provided between the neighboring pin electrodes. The plurality of pin electrodes are divided into n groups of pin electrodes from the pin electrode positioned at one end of the alignment with each group including m pin electrodes. One ends of the pin electrodes in one group are terminated at the elongated body and the other end thereof are connected to the elongated plate member in such a manner that the first, second, . . ., mth pin electrodes are electrically connected to the conductive surface of the first, second, . . ., mth sheets of the elongated plate members, respectively.

BRIEF DESCRIPTION OF THE DRAWINGS

These and other objects and features of the present invention will become apparent from the following description taken in conjunction with preferred embodiment thereof with reference to the accompanying drawings in which;

FIGS. 1 to 3 are drawings already referred to in the foregoing description, FIG. 1 being a schematic view of the conventional multi-pin electrode assembly, FIG. 2 being a diagrammatic view showing principle of the multi-pin electrode assembly, FIG. 3 being perspective view showing one intermediate step for manufacturing the multi-pin electrode assembly shown in FIG. 1;

DETAILED DESCRIPTION OF THE INVENTION

Figure 4:
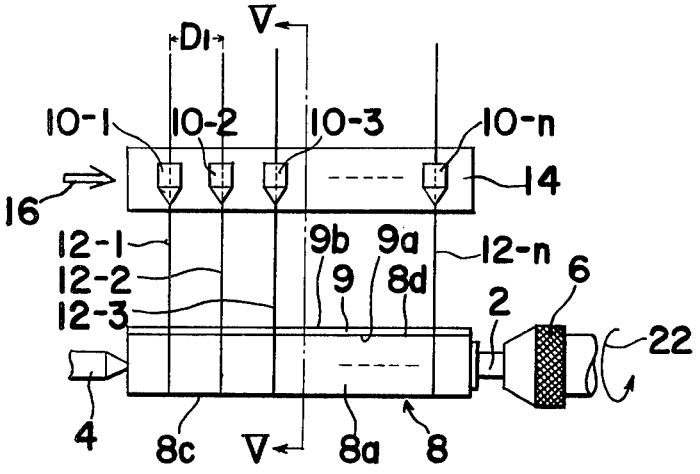
FIG. 4 is a top plan view schematically showing machine for manufacturing a multi-pin electrode assembly of the present invention.
Figure 5:
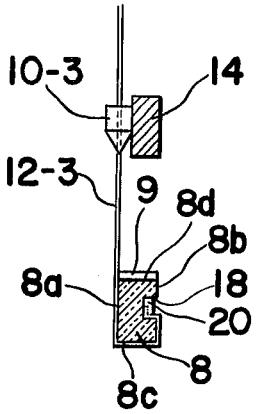
FIG. 5 is a cross sectional view taken along a line V—V shown in FIG. 4.
Figure 6:
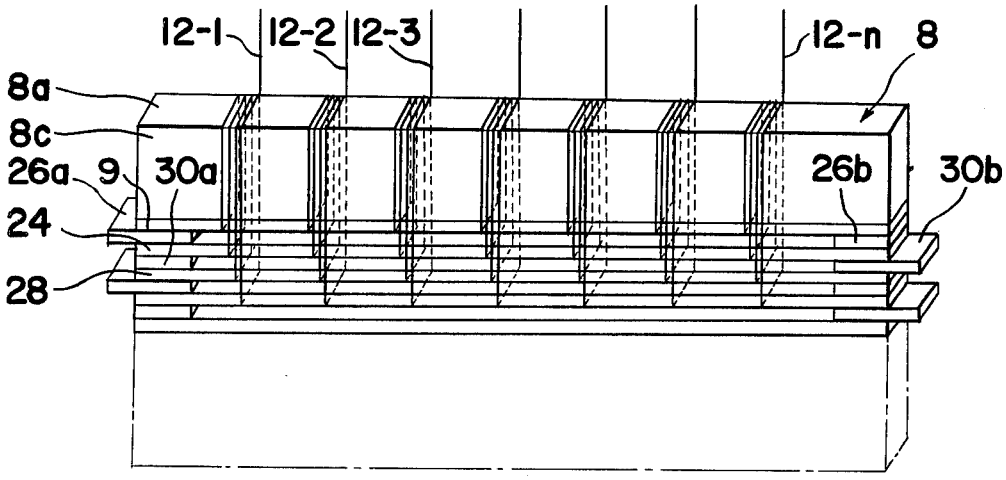
FIG. 6 is a perspective view showing one intermediate step for manufacturing the multi-pin electrode assembly of the present invention.

Referring to FIGS. 4 and 5, there is shown schematically one embodiment of a manufacturing machine for manufacturing a multi-pin electrode assembly of the present invention. The manufacturing machine includes a rotatable shaft or mounting shaft 2 which is connected to a driving motor (not shown) of the machine and a supporting projection or dead center 4 which is in alignment with the shaft 2. The mounting shaft 2 is so arranged as to move back and forth along an axis thereof by a clamping bolt 6 mounted on the shaft 2. An elongated body 8 which will occupy main part of the substratum of the pin electrode assembly is tightly clamped between the shaft 2 and the dead center 4. The elongated body 8 is made of insulating material such as synthetic resin and has, as best shown in FIG. 5, four elongated rectangular surfaces **8*a*, 8*b*, 8*c* and 8*d*, in which surfaces 8*a* and 8*b* are parallely extended in face to face relation to each other while the surfaces 8*c* and 8*d* are also parallely extended in face to face relation to each other. A plate member 9 having one flat surface 9*a* thereof being insulated, and the other flat surface 9*b* thereof provided with conductive material is provided on the elongated body 8 with the insulated surface 9*a* held in contact with the surface 8*d*. Disposed away from the shaft 2 and the elongated body 8 are a plurality of guiding nozzles 10-1, 10-2, . . ., 10-n for guiding wires 12-1, 12-2, . . ., 12-n, respectively, supplied from corresponding spools (not shown). The guiding nozzles are aligned in parallel relation to the axis of the shaft 2, while each of the guiding nozzles 10-1, 10-2, . . ., 10-n is rigidly provided on an elongated supporting plate 14 with a predetermined distance $D_1$ spaced apart from neighboring guiding nozzles. The distance $D_1$ is so determined as to have a predetermined number of pin electrodes in one group to align parallely within that distance. The elongated supporting plate 14 is provided to move in a direction indicated by an arrow 16. Each of the wires guided through the respective nozzle is extended towards the elongated body 8 at which the end of the wire is fixedly held on one surface thereof. According to this embodiment, the ends of the respective wires are fixedly held at the surface 8*b* of the elongated body 8 at which the ends of the wires are inserted into a groove 18 formed on the surface 8*b*, as best shown in FIG. 2, and are tightly held thereat by a filler member 20 which is rigidly accommodated in the groove 18, so as to prevent the wires from being disconnected from the groove 18** and to maintain the wires to space a predetermined distance $D_1$ apart from the neighboring wires.

The arrangement for manufacturing the multi-pin electrode assembly of the present invention thus far explained is shown in FIGS. 4 and 5. Thereafter, the shaft 2 is first rotated 90° about the axis thereof in a direction indicated by an arrow 22, and then, it is held in that first rotated position by a suitable engaging means (not shown). At this first rotated position, the wires 12-1, 12-2, . . ., 12-n are electrically connected by a suitable connecting means such as soldering onto the conductive surface **9*b* of the plate member 9. Then, another plate member 24 which is similar to the plate member 9 is placed over the plate member 9 through a pair of spacer members 26*a* and 26*b* positioned at opposite ends thereof. At least one of the spacer members such as spacer member 26*a* should preferably extrude out of the space formed between the two plate members 9 and 24 while the other spacer member such as spacer member 26*b* is preferable to be placed fitly accommodated in the space therebetween. The surface of the spacer member 26*a* which is in contact with the plate member 9 is provided with conductive layer and the other surface thereof which is in contact with the plate member 24 is insulated so as to electrically terminate the wires passed over the conductive surface 9*b* at the conductive layer of the spacer member 26*a*. In other words, the conductive layer of the spacer member 26*a* is identical with the terminal $T_1$ and the wires 12-1, 12-2, . . ., 12-n extended over the surface 8*c* of the elongated body are identical with the pin electrodes 1-1, 2-1, . . ., n-1 described before in connection with FIG. 2**.

Thereafter, the supporting plate 14 is moved by one pitch in the direction indicated by the arrow 16 to prevent the successive wires from crossing over with previously wound wires. Then, the shaft 2 is released from the engagement and is further rotated 360° about the axis thereof in the direction indicated by the arrow 22 to wind successive wires around the elongated body 8 and the plate member 24 at position closely adjacent the previously wound wires. In this position, the wires passed over the plate member 24 are soldered onto the conductive surface thereof. Then, another plate member 28 which is similar to the plate member 9 is provided over the plate member 24 through a pair of spacer members 30*a* and 30*b* in the similar manner as described above. Similarly, at least one of the spacer members 30*a* and 30*b* is provided to project outwardly from the space between the two plate members 24 and 28. According to this embodiment, the spacer member 30*b* is projected outwardly from the space therebetween, so as to provide the spacer member 30*b* as terminal for the second pin electrodes. Such operation as described above is repeated to have subsequent plate members to be placed and bonded one over the other with a pair of spacer members placed between the neighboring plate members, while the wires are wound around and soldered on each of the plate members.

Figure 7:
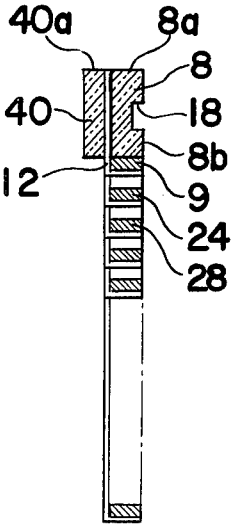
FIG. 7 is a side sectional view of the multi-pin electrode assembly of the present invention.

After thus having provided m sheets of the plate members and having wound each of the wires by m turns around the elongated body 8, the wires are cut after being soldered onto the final (mth) plate member, and the elongated body 8 together with the m sheets of plate members are removed from the manufacturing machine. Thereafter, another elongated body 40 which has a similar configuration to that of the above mentioned elongated body 8 is bonded onto the surface 8*c* of the body 8, so that the number of wires extended over the surface 8*c* of the body 8 is tightly held between the bodies 8 and 40. The filter member 20 provided in the groove 18 is removed and each of the wires extending from the groove 18 towards respecitve plate members where the wires are soldered are also removed. In addition, the wires projecting outwardly from the bodies 8 and 40 are removed by polishing the surface 8*a* and a surface of the body 40 which is in flush with the surface 8*a*, so as to obtain a completed pin electrode assembly of the present invention, as shown in FIG. 7.

It is to be noted that the spacer members described as bonded at the opposite edges of the respective plate members can be integrally formed with the respective plate members so that it is not necessary to bond such spacer members after each positioning of the plate members, thus the manufacturing steps being facilitated.

It is also to be noted that the supporting plate 14 can be provided with a suitable gauge member (not shown) for shifting a predetermined distance of pitch after every rotation of the elongated body 8.

According to the manufacturing method of the present invention, there is no particular steps necessary for dividing the pin electrodes into a plurality of groups, since the groups are already divided into required number of groups at the beginning of the manufacturing steps by the presentation of plurality of wires where each wire establishes one group. Furthermore, the pin electrodes which are positioned at the same place in each group can be simply connected to each other by the application of plate members provided one over the other after every one turn of wires wound around the elongated body and the cumulated plate members.

Therefore, in manufacturing the multi-pin electrode assembly of the present invention, there is no possibility of misleading nor misconnecting the pin electrodes, even if a number of pin electrodes is increased.

Instead of manufacturing one pin electrode assembly at one time, it is possible to manufacture, according to the present invention, two pin electrode assemblies at one time, which method is described hereinbelow in connection with FIG. 8.

Figure 8:
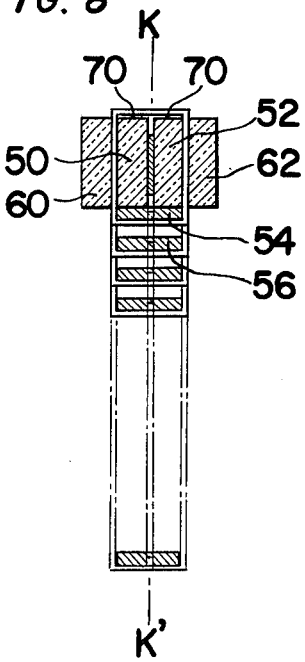
FIG. 8 is a similar view to FIG. 7, but particularly showing another embodiment thereof.

Referring to FIG. 8, there is shown a two multi-pin electrode assemblies combined together which can be separated from each other by cutting along a line K–K'. The two combined multi-pin electrode assemblies can be manufactured in the similar manner as above described. Instead of one elongated body 8, two elongated bodies 50 and 52 which are temporarily bonded together are clamped between the shaft 2 and the dead center 4. Then, the wires 12-1, 12-2, . . ., 12-n are wound therearound as the plate members 54, 56, . . . are cumulated one over the other through the spacer members with wires passed around one turn for each plate members. It is needless to say that the wires are soldered onto the plate members after each time the wires are pass around the newly applied plate member. Thereafter, the elongated bodies 50 and 52 are taken out from the manufacturing machine and are provided, at side surface thereof, with corresponding elongated bodies 60 and 62, respectively, as shown in FIG. 8, to tightly hold the wound wires at one place between the bodies 50 and 60 and at the other place between the bodies 52 and 62. The separation of the two assemblies can be effected by a suitable cutting means cutting along the line K–K'. Each of the separated assemblies is finished by polishing the upper surface 70 of the elongated bodies which is opposite surface to the surface cumulated with the plate members.

It is to be noted that each of the plate members 54, 56, . . . may be formed with groove along the center thereof in elongated direction for facilitating the separation of the assemblies.

According to the second manufacturing method described above, the manufacturing steps for the pin electrode assembly are further simplified without requiring any skilled workers.

Although the present invention has been fully described by way of examples with reference to the accompanying drawings, it is to be noted that various changes and modifications are apparent to those skilled in the art. Therefore, unless such changes and modifications depart from the scope of the present invention, they should be construed as included therein.

What is claimed is:

1. A multi-pin electrode assembly having a plurality of pin electrodes aligned in parallel to each other with a predetermined distance of pitch provided between the neighboring pin electrodes, said plurality of pin electrodes being divided into n groups of pin electrodes from the pin electrode positioned at one end of the alignment with each group including m pin electrodes, said n groups of pin electrodes being connected to each other in such a manner that n pin electrodes obtained by taking one pin electrode from each group positioned at the same place are connected to each other, said multi-pin electrode assembly comprising;

an insulated elongated body;

m sheets of elongated plate members each having insulated surface and electrical conductive surface which is opposite to said insulated surface, said elongated plate members cumulated on said elongated body with said insulated surface of one elongated plate member being in face to face relation with the conductive surface of neighboring elongated plate member;

an alignment of a plurality of pin electrodes extending in parallel to each other over said elongated body and said elongated plate members with a predetermined distance of pitch provided between the neighboring pin electrodes, said plurality of pin electrodes being divided into n groups of pin electrodes from the pin electrode positioned at one end of said alignment with each group including m pin electrodes, one ends of pin electrodes in each group terminated at said elongated body and the other end thereof connected to said elongated plate members in such a manner that the first, second, . . ., mth pin electrodes are electrically connected to said conductive surface of the first, second, . . ., mth sheets of elongated plate members, respectively; and means for holding said one end of every pin electrodes on said elongated body.

2. A multi-pin electrode assembly as claimed in claim 1 further comprising means for spacing neighboring elongated plate members.

3. A multi-pin electrode assembly as claimed in claim 2, wherein said spacing means are pairs of spacer elements each pair provided at opposite ends of the elongated plate members.

4. A multi-pin electrode assembly as claimed in claim 3, wherein at least one of each pair of spacer elements being formed with conductive material for electrically connecting said one spacer element with corresponding elongated plate member whose conductive surface is held in contact with said spacer element, thereby said pin electrodes connected to said corresponding elongated plate member electrically terminating at said one spacer element.

5. A multi-pin electrode assembly as claimed in claim 3, wherein said spacer elements are integrally formed with said elongated plate members.

6. A multi-pin electrode assembly as claimed in claim 1, wherein said holding means is an elongated bar member provided on said elongated body for holding said pin electrode between said elongated body and said elongated bar member.

* * * * *